US012612854B2

(12) United States Patent
Arukhe et al.

(10) Patent No.: US 12,612,854 B2
(45) Date of Patent: Apr. 28, 2026

(54) METHOD AND SYSTEM FOR PREDICTING THE LIFESPAN OF ELECTRIC SUBMERSIBLE PUMPS USING RANDOM-FOREST MACHINE-LEARNING

(71) Applicant: SAUDI ARABIAN OIL COMPANY, Dhahran (SA)

(72) Inventors: James O. Arukhe, Dhahran (SA); Torty C. Kalu-Ulu, Ras Tanura (SA); Suhail A. Samman, Riyadh (SA); Hamad M. Almarri, Nuayriyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 509 days.

(21) Appl. No.: 18/194,053

(22) Filed: Mar. 31, 2023

(65) Prior Publication Data

US 2024/0328303 A1 Oct. 3, 2024

(51) Int. Cl.
*E21B 47/008* (2012.01)

(52) U.S. Cl.
CPC ..... *E21B 47/008* (2020.05); *E21B 2200/22* (2020.05)

(58) Field of Classification Search
None
See application file for complete search history.

(56) References Cited

U.S. PATENT DOCUMENTS

2015/0241881 A1* 8/2015 Ige ..... E21B 43/128 700/282
2022/0214474 A1* 7/2022 Nistala ..... E21B 47/10
2022/0414299 A1* 12/2022 Benzvi ..... G06N 20/20
2023/0212937 A1* 7/2023 Pang ..... G06N 3/045 166/250.01
2025/0067164 A1* 2/2025 Gupta ..... E21B 44/00
2025/0092770 A1* 3/2025 Gupta ..... E21B 47/008

FOREIGN PATENT DOCUMENTS

WO WO-2023009741 A1 * 2/2023 ..... G06N 20/00

OTHER PUBLICATIONS

Ramez Abdalla, Hanin Samara, Nelson Perozo, Carlos Paz Carvajal, and Philip Jaeger, Machine Learning Approach for Predictive Maintenance of the Electrical Submersible Pumps (ESPs), ACS Omega 2022 7 (21), 17641-17651, DOI: 10.1021/acsomega.1c05881 (Year: 2022).*

Sneed, Jessamyn et al., "Predicting ESP Lifespan With Machine Learning"; SEG Global Meeting Abstracts; Unconventional Resources Technology Conference (URTeC 2017); URTec: 2669988; pp. 863-869; Sep. 2017 (7 pages).

(Continued)

*Primary Examiner* — Lina Cordero
(74) *Attorney, Agent, or Firm* — Osha Bergman Watanabe & Burton LLP

(57) ABSTRACT

A method for predicting a lifespan of an electric submersible pump (ESP) involves obtaining data associated with the ESP, the data originating from different categories, predicting, using a machine learning model, based on the data, a remaining expected life of the ESP, and reporting the remaining expected life.

5 Claims, 5 Drawing Sheets

(56) References Cited

OTHER PUBLICATIONS

Al-Khalifa, Mohammed A. et al., "ESP Reliability Lessons Learned From Three H2S Saudi Arabian Fields"; Proceedings of the SPE Middle East Artificial Lift Conference and Exhibition; Paper No. SPE-184176-MS; pp. 1-13; Nov. 30, 2016 (13 pages).
Mubarak, Hisham A. et al., "ESP Failures / Analysis / Solutions in Divided Zone—Case Study"; Proceedings of the Middle East Oil Show; Paper No. SPE-81488-MS; pp. 1-6; Jun. 9, 2023 (6 pages).
Marin, Antonio Andrade et al., "ESP Well and Component Failure Prediction in Advance using Engineered Analytics—A Breakthrough in Minimizing Unscheduled Subsurface Deferments"; Proceedings of the Abu Dhabi International Petroleum Exhibition & Conference; Paper No. SPE-197806-MS; pp. 1-23; Nov. 11, 2019 (23 pages).
Khabibullin, Rinat Alfredovich et al., "Prediction of ESPs Failure Using ML at Western Siberia Oilfields with Large Number of Wells"; Proceedings of the SPE Russian Petroleum Technology Conference; Paper No. SPE-201881-MS; pp. 1-16; Oct. 26, 2020 (16 pages).

* cited by examiner

METHOD AND SYSTEM FOR PREDICTING THE LIFESPAN OF ELECTRIC SUBMERSIBLE PUMPS USING RANDOM-FOREST MACHINE-LEARNING

BACKGROUND

Many oil wells are artificially lifted via electric submersible pumps (ESPs). ESP failures often result in significant production deferment until workover is completed to replace the failed ESPs. The lifespan ESPs may be negatively affected by many factors such as high pressure, high temperature, sour oil environment, etc. Accordingly, predicting the expected remaining lifespan of an ESP is nontrivial.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method for predicting a lifespan of an electric submersible pump (ESP), the method comprising: obtaining data associated with the ESP, the data originating from a plurality of different categories; predicting, using a machine learning model, based on the data, a remaining expected life of the ESP; and reporting the remaining expected life.

In general, in one aspect, embodiments relate to a system for predicting a lifespan of an electric submersible pump (ESP), the system comprising: a plurality of sensors configured to measure first parameters associated with the ESP; a database configured to store second parameters associated with the ESP; and a prediction engine configured to: obtain data associated with the ESP, the data originating from a plurality of different categories and the data comprising the first parameters and the second parameters; predict, using a machine learning model, based on the data, a remaining expected life of the ESP; and report the remaining expected life.

In general, in one aspect, embodiments relate to a non-transitory machine-readable medium comprising a plurality of machine-readable instructions executed by one or more processors, the plurality of machine-readable instructions causing the one or more processors to perform operations comprising: obtaining data associated with an ESP, the data originating from a plurality of different categories; predicting, using a machine learning model, based on the data, a remaining expected life of the ESP; and reporting the remaining expected life.

In light of the structure and functions described above, embodiments of the invention may include respective means adapted to carry out various steps and functions defined above in accordance with one or more aspects and any one of the embodiments of one or more aspect described herein.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
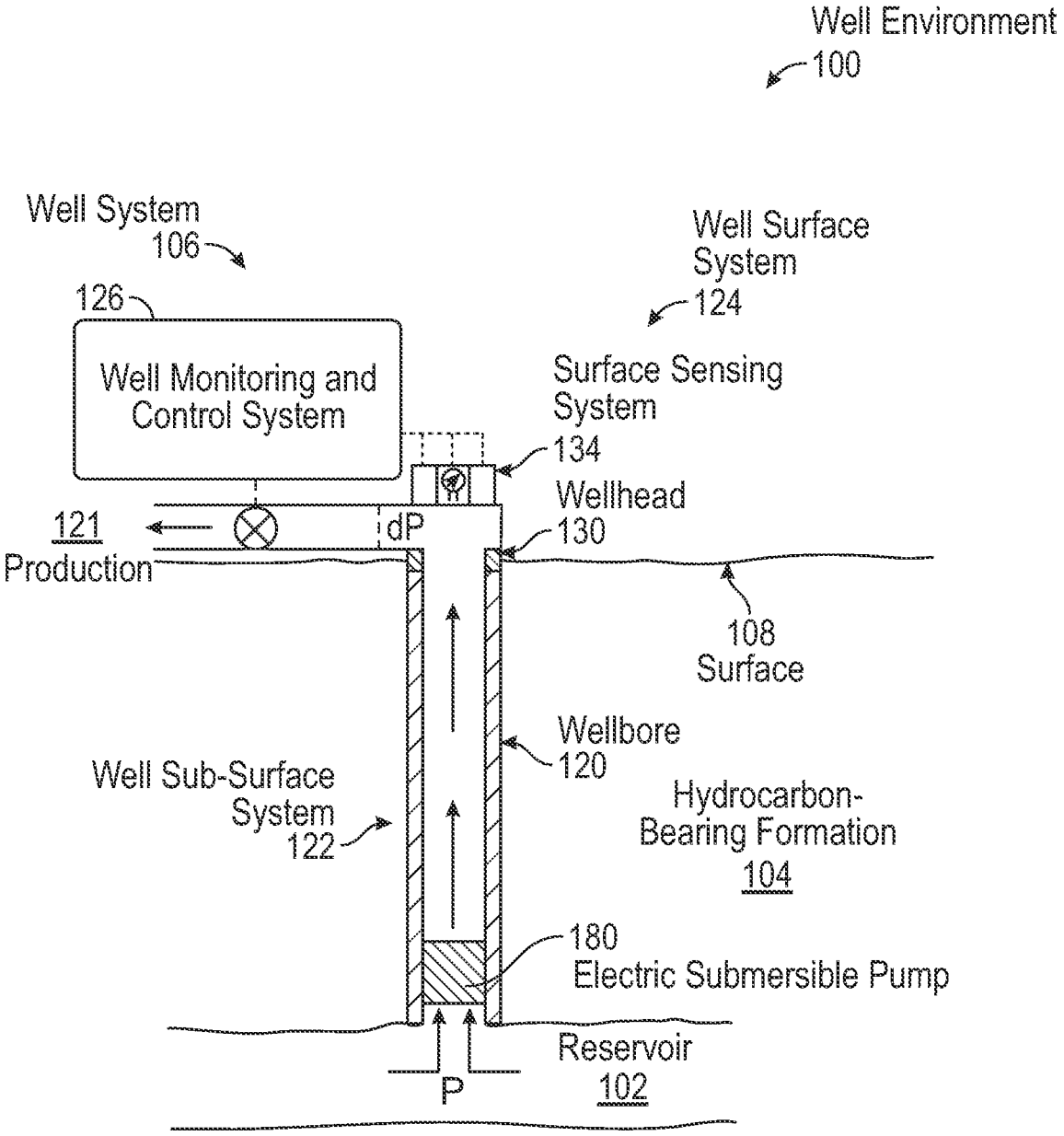
FIG. 1 shows a well environment in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Many oil wells are artificially lifted via electric submersible pumps (ESPs). ESP failures often result in significant production deferment until workover is completed to replace the failed ESPs. As failures and breakdown seem inevitable with continuous ESP operations, being able to predict failures, and thereby being able to reduce any substantial downtime and relative maintenance costs, would be highly beneficial. However, with the lifespan of ESPs potentially being negatively affected by many factors such as high pressure, high temperature, sour oil environment, etc., predicting the expected remaining lifespan of an ESP is nontrivial.

Embodiments of the disclosure provide a prediction of the expected remaining lifespan of ESPs. A machine learning model is used for the prediction. In one embodiment of the disclosure, the machine learning model is a random forest model to predict the lifespan and detect premature ESP failures. The disclosed embodiments have the ability to alert the user of potential failures ahead of time, thus providing the user with the benefit of being able to plan in advance to avoid production losses by formulating mitigation strategies to prolong ESP lifespan. While the presence of $H_2S$, high pressure and/or temperature, results in particularly harsh environments for ESPs and adversely affect their integrity and reliability, the machine learning model may also be used for other applications, e.g., in non-sour environments.

Embodiments of the disclosure may be used to accurately predict failure, optimizing ESP operation, and predict ESP health, thus making it easy to schedule ESP replacement when needed. Embodiments of the disclosure thereby help reduce the loss of production that would occur due to sudden, unexpected ESP failures. Unlike other predictive methods that can be computationally demanding, embodiments of the disclosure are computationally efficient, while providing a high degree of robustness and accuracy. They further generalize well, with a relatively low overall variance, and a low bias. Additional details are subsequently provided, after an introductory discussion of well environments.

FIG. 1 shows a well environment (100) in accordance with embodiments of the disclosure. The well environment (100) includes a hydrocarbon reservoir ("reservoir") (102) located in a subsurface hydrocarbon-bearing formation (104) and a well system (106). The hydrocarbon-bearing formation (104) may include a porous or fractured rock formation that resides underground, beneath the earth's surface ("surface") (108). In the case of the well system (106) being a hydrocarbon well, the reservoir (102) may include a portion of the hydrocarbon-bearing formation (104). The hydrocarbon-bearing formation (104) and the reservoir (102) may include different layers of rock having varying characteristics, such as varying degrees of permeability, porosity, and resistivity. In the case of the well system (106) being operated as a production well, the well system (106) may facilitate the extraction of hydrocarbons (or "production") from the reservoir (102). In the case of the well system (106) being operated as an injection well, the well system (106) may be used in a tertiary recovery method to displace the produced hydrocarbons and/or to maintain the pressure profile of the reservoir (102).

In some embodiments, the well system (106) includes a wellbore (120), a well sub-surface system (122), a well surface system (124), and a well monitoring and control system (126). The well monitoring and control system (126) may monitor and/or control various operations of the well system (106), such as well production operations, well completion operations, well maintenance operations, and reservoir monitoring, assessment and development operations. In one or more embodiments, the well monitoring and control system (126) is configured to operate and or monitor the electric submersible pump (ESP) (180), as further discussed below. In some embodiments, the well monitoring and control system (126) includes a computer system that is the same as or similar to that of computer system (502) described below in FIG. 5 and the accompanying description.

The wellbore (120) may include a bored hole that extends from the surface (108) into a target zone of the hydrocarbon-bearing formation (104), such as the reservoir (102). An upper end of the wellbore (120), terminating at or near the surface (108), may be referred to as the "up-hole" end of the wellbore (120), and a lower end of the wellbore, terminating in the hydrocarbon-bearing formation (104), may be referred to as the "downhole" end of the wellbore (120). The wellbore (120) may facilitate the circulation of drilling fluids during drilling operations, the flow of hydrocarbon production ("production") (121) (e.g., oil and gas) from the reservoir (102) to the surface (108) during production operations, the injection of substances (e.g., water) into the hydrocarbon-bearing formation (104) or the reservoir (102) during injection operations, or the communication of monitoring devices (e.g., logging tools) into the hydrocarbon-bearing formation (104) or the reservoir (102) during monitoring operations (e.g., during in situ logging operations).

In one or more embodiments, the well system (106) is an artificially lifted well system with an ESP (180) supporting production (121). The ESP (180) may be any type of submersible pump, e.g., a multistage centrifugal pump. Stages may be stacked based on the operating requirements of the well system (106). Many different factors, including the environmental conditions in the wellbore (120) may result in mechanical and/or electrical failures within several ESP parts, thereby affecting run life.

In one or more embodiments, during operation of the well system (106), the well monitoring and control system (126) monitors and controls the ESP (180). In one or more embodiments, the monitoring and control system (126) performs operations of methods described in reference to the flowchart of FIGS. 3 and 4. Software instructions in the form of computer readable program code to perform the operations in accordance with embodiments may be stored, in whole or in part, temporarily or permanently, on a non-transitory computer readable medium. The well monitoring and control system (126) may further collect and record wellhead data for the well system (106) and other data regarding downhole equipment and downhole sensors. The wellhead data may include, for example, a record of measurements of wellhead pressure (P) (e.g., including flowing wellhead pressure (FWHP)), wellhead temperature (T) (e.g., including flowing wellhead temperature), wellhead production rate (R) over some or all of the life of the well system (106), and/or water cut data. In some embodiments, the measurements are recorded in real-time, and are available for review or use within seconds, minutes or hours of the condition being sensed (e.g., the measurements are available within 1 hour of the condition being sensed). In such an embodiment, the wellhead data may be referred to as "real-time" wellhead data. Real-time wellhead data may enable an operator of the well to assess a relatively current state of the well system (106), and make real-time decisions regarding development of the well system (106) and the reservoir (102), such as on-demand adjustments in regulation of production flow from the well or injection flow to the well.

In some embodiments, the well surface system (124) includes a wellhead (130). The wellhead (130) may include a rigid structure installed at the "up-hole" end of the wellbore (120), at or near where the wellbore (120) terminates at the Earth's surface (108). The wellhead (130) may include structures for supporting (or "hanging") casing and production tubing extending into the wellbore (120). Production (121) may flow through the wellhead (130), after exiting the wellbore (120) and the well sub-surface system (122), including, for example, the casing and the production tubing.

In some embodiments, the well surface system (124) includes a surface sensing system (134). The surface sensing system (134) may include sensor devices for sensing characteristics of substances, including production (121), passing through or otherwise located in the well surface system (124). The characteristics may include, for example, pressure, temperature and flow rate of production (121) flowing through the wellhead (130), or other conduits of the well surface system (124), after exiting the wellbore (120).

While FIG. 1 shows various configurations of hardware components and/or software components, other configurations may be used without departing from the scope of the disclosure. For example, various components in FIG. 1 may be combined to create a single component. As another example, the functionality performed by a single component may be performed by two or more components.

Figure 2:
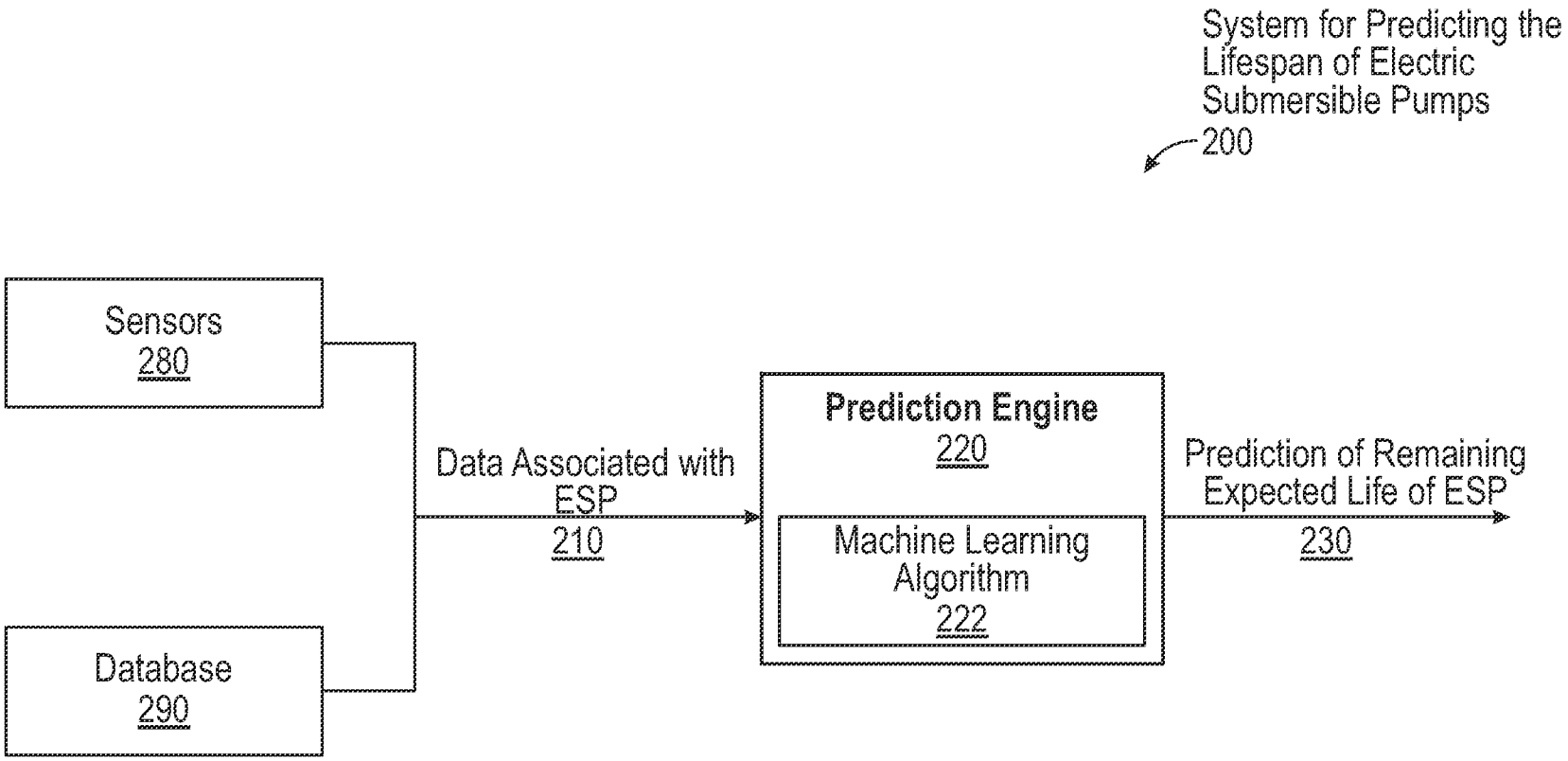
FIG. 2 shows a system in accordance with one or more embodiments.

FIG. 2 shows a system (200) for predicting the lifespan of an ESP, in accordance with one or more embodiments. The system (200) includes a prediction engine (220) that operates on data (210) associated with the operation of the ESP to generate a prediction (230) of the lifespan of the ESP. In one or more embodiments, the prediction (230) is made by a machine learning algorithm (222). The machine learning algorithm, in one embodiment, is a random forest model, which may operate as a supervised machine learning algorithm performing a regression to predict the timeline of a failure event for the ESP.

A random forest model is an ensemble machine learning algorithm that uses multiple decision trees to make predictions. The architecture of random forest models is unique in that it combines multiple decision trees to reduce the risk of overfitting and improve the overall generalization of the model and the accuracy of predictions, in comparison to individual trees. This is based on the idea that multiple "weak learners" can combine to create a "strong learner." Each individual classifier is considered a "weak learner," while the group of classifiers functioning together is regarded as a "strong learner." This approach allows random forests to effectively capture complex relationships and interactions between features, resulting in better predictive performance.

Each of the multiple decision trees operates on a different subset of the same dataset, followed by taking an average of the results to improve the overall accuracy of the predictions. In other words, instead of relying on a single decision tree, the random forest gathers predictions from each tree and makes a final prediction based on the majority of these predictions.

The architecture of a random forest model is suitable for predicting the failure of an ESP because it is capable of capturing complex and non-linear relationships between predictors and a target variable. The predictors may originate from different categories. Data (210) associated with the ESP may be collected for these predictors and may serve as inputs to the prediction engine (220). Examples of the different categories and predictors in these categories include, but are not limited to:

- ESP operational parameters: predictors include, for example, voltage, current, power, motor temperature, discharge pressure, vibration, frequency, insulation resistance of the motor lead extension (MLE) conductor in Giga Ohms;
- Environmental parameters: predictors include, for example, temperature (intake temperature, wellhead temperature), pressure (intake pressure, wellhead pressure), fluid type (e.g., viscosity of fluid, gas oil ratio, sour gas concentration), well depth, well productivity;
- Design parameters: predictors include, for example, flow rate, pump speed;
- Historical data: predictors include, for example, ESP operating hours, number of start-stop cycles, production history (e.g., cumulative run time, uptime, downtime), maintenance history (e.g., previous repairs, service intervals, spare parts usage); and
- Equipment specifications: predictors include, for example, types of materials used for the ESP components, chemical composition, mechanical properties, geometry and dimensions of the ESP components, spacing between electrodes, type of insulation material, and power rating.

Data (210) associated with the ESP may vary based on the specific ESP system and the data available. These and other data that may be acquired in real-time or near-real-time, e.g., by sensors (280) as shown in FIG. 2. Other data may be obtained from a database (290). The choice of predictors in the data (210) to be used by the prediction engine (220) may affect the predictive performance and may be part of the training of the machine learning algorithm (222) as described below in reference to FIG. 3.

Those skilled in the art will appreciate that the data (210) mentioned above are some examples of the input variables that may be used to build the random forest machine learning model to predict ESP lifespans in sour high-pressure and temperature environments. These inputs are fed into each node of a decision tree to build the random forest model. Feeding more inputs into a random forest predictive model can increase the complexity of the model and potentially lead to better predictions. On one hand, feeding more inputs can provide the model with more information fundamental to the performance of the ESP, and potentially improve its accuracy. On the other hand, to overcome the challenge of overfitting that results with increasing the size of the feature space and reducing the risk of the model relying too heavily on any one input, or from the additional irrelevant inputs that may contain noise, additional processing is required. Specifically, feature selection and cross-validation may be performed on the data. Cross-validation involves splitting the data into multiple training and validation sets and testing the random forest (ML) model on each of these. For example, cross-validation may be performed using the cross-val-score function from the scikit-learn library using Python software available in Anaconda.

The prediction (230) of remaining expected life of the ESP is the output of the prediction engine (220) when operating on the data (210) associated with the ESP. The prediction (230) of the remaining expected life of the ESP may be a number, such as the number of days remaining until failure, rather than a specific date or time of the anticipated failure or a more general measure of pump deterioration.

Figure 3:
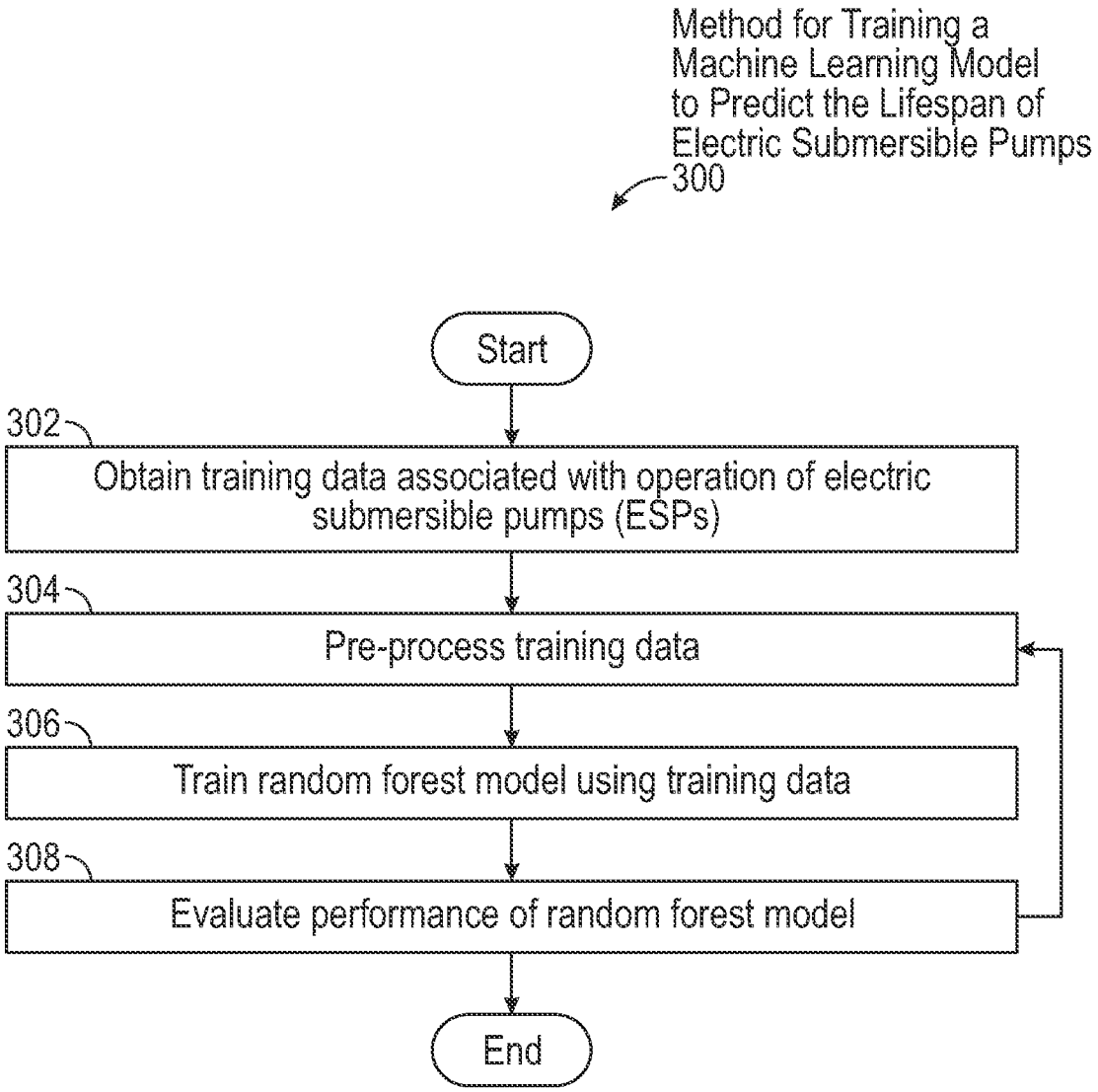
FIG. 3 shows a flowchart for a method in accordance with one or more embodiments.
Figure 4:
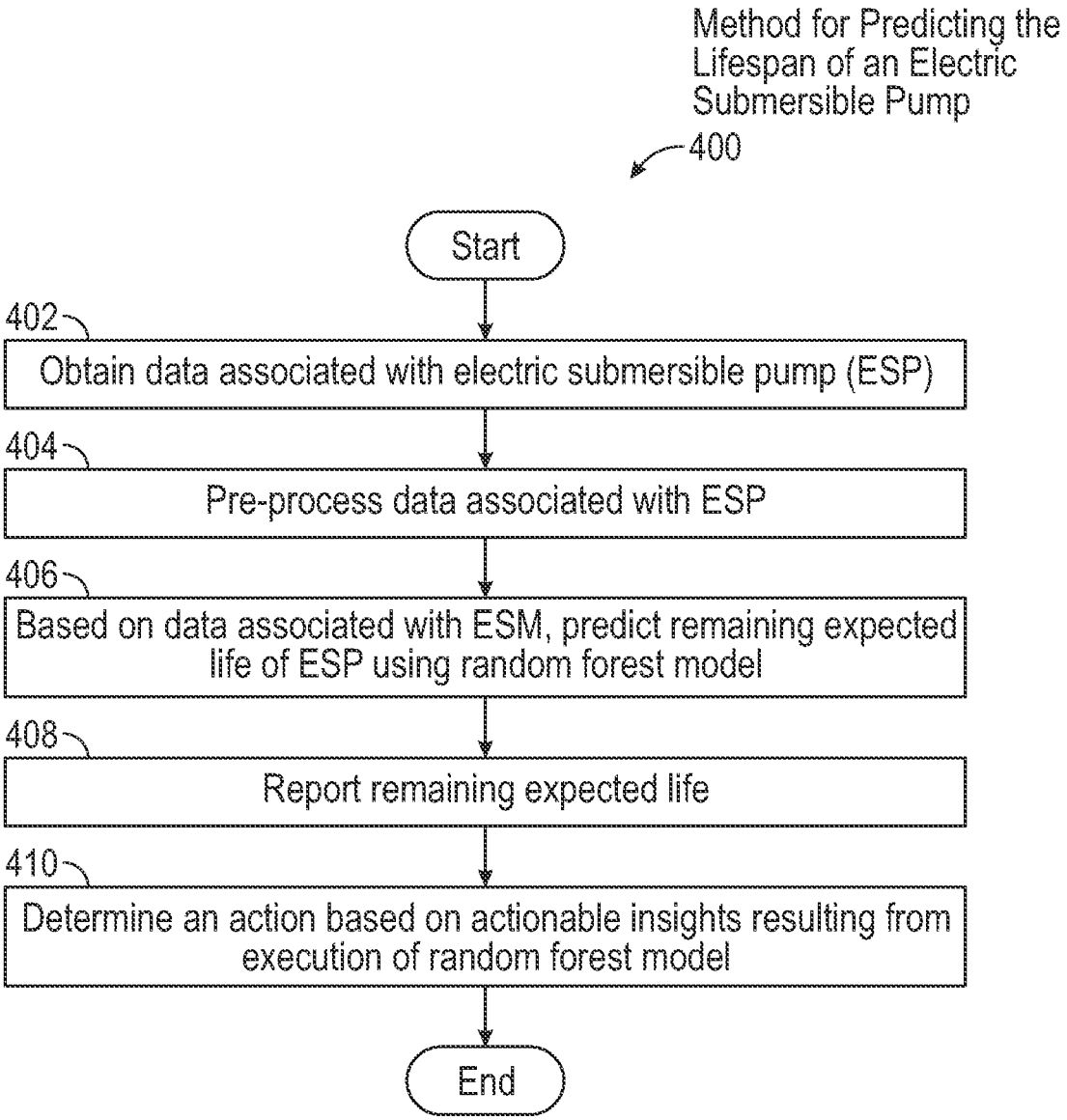
FIG. 4 shows a flowchart for a method in accordance with one or more embodiments.

FIGS. 3 and 4 show flowcharts in accordance with one or more embodiments. One or more steps in FIGS. 3 and 4 may be performed by one or more components (e.g., well monitoring and control system (126) as described in FIG. 1). While the various steps in FIGS. 3 and 4 are presented and described sequentially, one of ordinary skill in the art will appreciate that some or all of the steps may be executed in different orders, may be combined or omitted, and some or all of the steps may be executed in parallel. Furthermore, the blocks may be performed actively or passively.

FIG. 3, a method for training a random forest model, in accordance with one or more embodiments, is shown.

The training may be achieved by training the machine learning model on training data where the target variable is the time until failure, and the input features are related to ESPs and their environments.

In Step 302, the training data associated with the operation of ESPs are obtained. The training data may include data associated with any of the predictors in any of the categories as previously described. For example, the training data may be historical data recorded from ESPs as they were operating over time. The historical data may also include a documentation of failures of these ESPs, thereby allowing the training data to be used for a supervised training of the machine learning algorithm. To ensure good generalization, the training data may be comprehensive and may include data from different well environments, for different ESPs, etc. In other words, training data that accurately and completely covers the lifetime of the ESPs is obtained. The training data may include features that are based on any combination of the parameters previously discussed.

In Step 304, the training data is pre-processed. The training data may be corrupted, noisy, or incomplete, making it difficult to build a robust model. Accordingly, the training data may be pre-processed to remove errors, outliers, or missing values. The pre-processing may further involve feature engineering. The feature engineering may identify the most influential features that contribute to ESP failure, to improve the accuracy of the model. Less relevant or irrelevant features may be removed from the training data. Different tools may be used to identify the relevance and characteristics of features.

For example, a heatmap may be used to visually represent and analyze the relationship between two variables using a color-coded grid. The heatmap may provide insights into the strength, direction, and shape of the relationship between the two variables. Also, histograms may be used to visually explore the distribution of the data and to help identify patterns and relationships between variables.

The pre-processing of the training data may also involve a data transformation that involves converting the training data into a suitable format for the training of the machine learning model. The data transformation may involve, for example, scaling or normalizing of features.

In Step 306, the random forest model is trained. Bagging (bootstrap aggregating) may be used for the training. The training involves a random split of the training data into a training data set, a validation data set, and a test data set. The ratio for the random split may be, for example, 80:10:10.

The training data set may be used to train the random forest model. The algorithm uses the data in the training data set to learn patterns and relationships between the features and the target variable.

The validation data set may be used to fine-tune the hyperparameters of the model. The hyperparameters are parameters that are not learned by the model during training, but rather set by the user. These control the behavior of the algorithm and can have a significant impact on the performance of the model. The validation data set is used to test different combinations of hyperparameters and select the ones that result in the best performance.

The test data set may be used to evaluate the final performance of the random forest model. Once the hyperparameters have been selected using the validation data set, the model is trained again using both the training and validation data sets, and the test data set is used to evaluate its performance. The test data set is a completely independent set of data that the model has never seen before and is used to estimate how the model will perform on new, unseen data. By splitting the training data into a training data set, a validation data set, and a test data set, a robust and reliable random forest model that can generalize well to new, unseen data may be obtained.

The random split may be performed using a sampling with replacement. Training the random forest model in building a random forest model entails the process of building multiple decision trees, where each tree is constructed using a random subset of features and a random subset of the training data set. During the training process, the decision trees are iteratively built by splitting the data at each node based on the best feature that separates the data points. The splitting may be performed such that the impurity of the data points at each node is minimized, e.g., based on a mean-squared error. The random forest model may be trained until the desired number of decision trees is built, and each tree grown to the maximum depth. Once trained, each tree makes a prediction based on its own set of decision rules. The final prediction is based on the average or majority vote of the individual tree predictions.

The described approach helps to avoid unstable models that cannot adapt to the addition of new data as well as overfit models that do not generalize well. The use of class weights in this method gives importance to minority classes when handling imbalanced data. There is no need to prune as in decision trees. In the course of prediction, every tree is utilized for making distinctive predictions. The predictions are combined through voting such as the obtaining of the average outcomes.

In Step 308, the performance of the random forest model is evaluated. Evaluation of the performance may involve a model selection performed to ensure that the model accurately captures the relationship between the input features and the time until failure. Further, the trained random forest model is validated using the test data set to ensure that it generalizes well to new cases.

Steps 304-308 form a training iteration. After completion of a training iteration, the relevance of the features in the training data may be evaluated. To determine the relevance of a feature, a measure called "feature importance" is used. It is calculated by considering the reduction in impurity at a node, weighted by the probability of reaching that node. This probability is calculated by dividing the number of samples that reach that node by the total number of samples. If the value of the feature importance is higher, it indicates that the feature is more important. Less relevant or irrelevant features may be eliminated in a subsequently performed training iteration. In other words, Steps 304-308 may be repeated, e.g., with irrelevant features removed.

The execution of the method including training of the random forest with different sets of hyperparameters may end when a random forest model achieves the desired performance, or no further performance improvements can be achieved. The model selection may be used to select the best-performing model (based on specified performance metrics) of the models that have been generated by repeatedly performing Steps 304-308. Metrics used for evaluation may include, for example, the mean squared error (MSE), mean absolute error (MAE), root mean squared error (RMSE), and R-squared.

After completion of the training, a random forest model is available to perform prediction of the timeline of a failure event for an ESP, as discussed in reference to FIG. 4.

FIG. 4 shows a method for predicting the lifespan of an ESP, in accordance with one or more embodiments.

In Step 402, data associated with the ESP are obtained. The data may include parameters as those used for the training of the random forest model. Some of the parameters may be obtained from sensors, e.g., in real-time or near-real-time. Other parameters may be obtained from databases.

In Step 404, the data associated with the ESP are pre-processed. The pre-processing may be performed analogous to the pre-processing in Step 304.

In Step 406, the expected remaining life of the ESP is predicted. The prediction is performed using the random forest model operating on the data associated with the ESP. Given the data, the model applies the set of decision trees in the random forest to the data, and the prediction is generated by aggregating the predictions of the individual trees by calculating the mean. The timeline of failure events in this context refers to the predicted output values for each time point in the future, based on the input features provided to the model.

In Step 408, the remaining expected life is reported. The value may be reported to a user. A warning or notification may be provided when the remaining expected life drops below a specified threshold value.

In Step 410, actions may be taken, based on various actionable insights resulting from the execution of the method. These actions are subsequently discussed.

1. Feature Importance: The random forest model is capable of identifying the most significant features that impact the lifespan of ESPs. This information can help prioritize improvements to areas with the highest impact on extending the ESP lifespan. In one example, the most important feature that affect the lifespan of ESPs includes the idle time of the ESP in the downhole prior to commissioning and active service.

Prolonged installation of an electrical submersible pump in sour, high temperature, and pressure environments before active service and operation can have several consequences, including:

Corrosion: The sour environment can cause corrosion of the pump and associated equipment, leading to degradation and failure.

Reduced Pump Life: High temperature and pressure can cause wear and tear on the pump's components, reducing its lifespan and efficiency.

Contamination: The prolonged exposure of the pump to the sour environment can contaminate the well fluids and negatively impact the production of the well.

Safety Risks: The sour environment poses safety risks to workers, such as the risk of exposure to harmful chemicals, resulting in potential health hazards.

Increased Costs: The need to replace or repair the pump prematurely due to prolonged installation in a sour environment can lead to increased costs for maintenance and replacement.

In summary, prolonged installation of an electrical submersible pump in sour, high temperature, and pressure environments before active service and operation can result in corrosion, reduced pump life, contamination, safety risks, and increased costs. In sour, high pressure, high temperature environments, the ESP must further endure adverse temperature and pressure conditions of the downhole environment inside the wellbore. These adverse conditions often have negative effects on the integrity of the pump, power cable, causing damage, burns, voltage fluctuations, connection issues, and other problems. It is important to follow proper installation procedures to ensure the optimal functioning and longevity of the pump.

2. Early Failure Detection: The model is capable of detecting ESPs that are likely to fail in the near future. This information may be used to schedule maintenance or replacement of ESPs before they fail, minimizing downtime and production loss.

The importance of early failure detection of an electrical submersible pump in sour, high-temperature and pressure environments can be summarized as follows:

Minimizes Production Downtime: Detecting pump failure early allows for quick repairs, minimizing the amount of production downtime and preventing revenue loss.

Reduces Repair Costs: Early detection of pump failure can prevent more severe damage to the pump and associated equipment, reducing the repair costs.

Enhances Safety: Early detection of pump failure can prevent accidents and injuries that may arise from the sudden failure of equipment, ensuring the safety of workers.

Improves Equipment Life: Prompt repairs of pump failure can prolong the equipment's lifespan, reducing the need for frequent replacements.

Maintains Production Efficiency: Early detection of pump failure ensures that the well continues to produce efficiently, avoiding a decrease in production and the associated financial losses.

In summary, implementing a comprehensive monitoring and detection system for early failure detection of an electrical submersible pump in sour, high-temperature and pressure environments is crucial to minimize production downtime, reduce repair costs, enhance safety, improve equipment life, and maintain production efficiency.

3. Optimize ESP Operation: The model is capable of optimizing the operational parameters of ESPs by analyzing the relationship between various features and ESP lifespan. This can result in more efficient operation, lower energy consumption, and extended ESP lifespan.

The importance of optimizing the operation of submersible pumps in sour, high-temperature, and pressure environments can be summarized as follows:

Improves Production Efficiency: By optimizing the pump operation, the well can produce at its maximum capacity, resulting in increased production efficiency.

Reduces Energy Consumption: Optimized pump operation requires less energy, resulting in reduced energy consumption and cost savings.

Extends Equipment Life: Properly optimized pump operation reduces the wear and tear on the equipment, prolonging its lifespan and reducing the need for frequent replacements.

Enhances Safety: Optimal pump operation can prevent accidents and injuries that may arise from the sudden failure of equipment, ensuring the safety of workers.

Minimizes Environmental Impact: Optimized pump operation reduces the risk of spills and leaks, minimizing the environmental impact of oil and gas production.

In summary, it is crucial to implement a comprehensive monitoring and optimization system to ensure that the pump operates efficiently and reliably. By doing so, it may improve production efficiency, reduce energy consumption, extend equipment life, enhance safety, and minimize environmental impact. Therefore, optimizing the operation of submersible pumps in sour, high-temperature, and pressure environments is of utmost importance for the success and sustainability of oil and gas production.

4. ESP Design Improvement: The insights provided by the model can be used to improve the design of future ESPs. For example, if the model identifies that a particular material or design feature has a significant impact on ESP lifespan, this information can be used to improve the design of the ESPs to make them more durable and reliable.

The importance of enhancing the design of electrical submersible pumps in sour, high-temperature, and pressure environments cannot be overemphasized. The following are reasons why improving pump design is crucial:

Better Performance: Design improvements can significantly boost pump performance, making it more efficient and effective in challenging environments.

Enhanced Reliability: An improved pump design is more reliable, reducing downtime and enhancing production efficiency.

Reduced Maintenance Costs: A pump with a better design requires less maintenance, resulting in lower maintenance costs and an extended lifespan.

Improved Safety: A well-designed pump minimizes the likelihood of accidents and injuries, ensuring the safety of workers and the environment.

Enhanced Sustainability: An improved pump design can help reduce the environmental impact of oil and gas production, contributing to a more sustainable energy future.

The significance of investing in research and development to improve the design of electrical submersible pumps in sour, high-temperature, and pressure environments is evident. Improving pump design can lead to better performance, enhanced reliability, reduced maintenance costs, improved safety, and enhanced sustainability.

5. Cost Savings: Extending the lifespan of ESPs can lead to significant cost savings in maintenance and replacement costs. Reasons for why it is essential to prolong the lifespan of submersible pumps include, for example:

Reduced Costs for Replacement: Extending the lifespan of a pump reduces the frequency of replacement, which, in turn, leads to a reduction in replacement costs.

Lower Maintenance Costs: Maintaining a pump adequately reduces the cost of maintenance, resulting in significant cost savings over time.

Increased Production Efficiency: A pump that operates more efficiently due to its extended lifespan leads to less downtime and production losses.

Improved Safety: Extending the lifespan of a pump reduces the chances of accidents and injuries, making the work environment safer.

Decreased Environmental Impact: Extending the lifespan of a pump means fewer requirements for new equipment, resulting in less waste and a lower environmental impact.

In conclusion, cost savings are a significant factor in extending the lifespan of electrical submersible pumps in sour, high-temperature, and pressure environments. It leads to a decrease in replacement and maintenance costs, increased production efficiency, improved safety, and reduced environmental impact.

In summary, a random forest machine learning model for predicting ESP lifespans in sour high-pressure and high-temperature environments can offer multiple actionable insights that can optimize the operation of ESPs, improve their design, and save costs.

The method (400) may be executed in a loop, e.g., whenever new data become available, or at a fixed rate, e.g., once per hour, once per day, etc.

Figure 5:
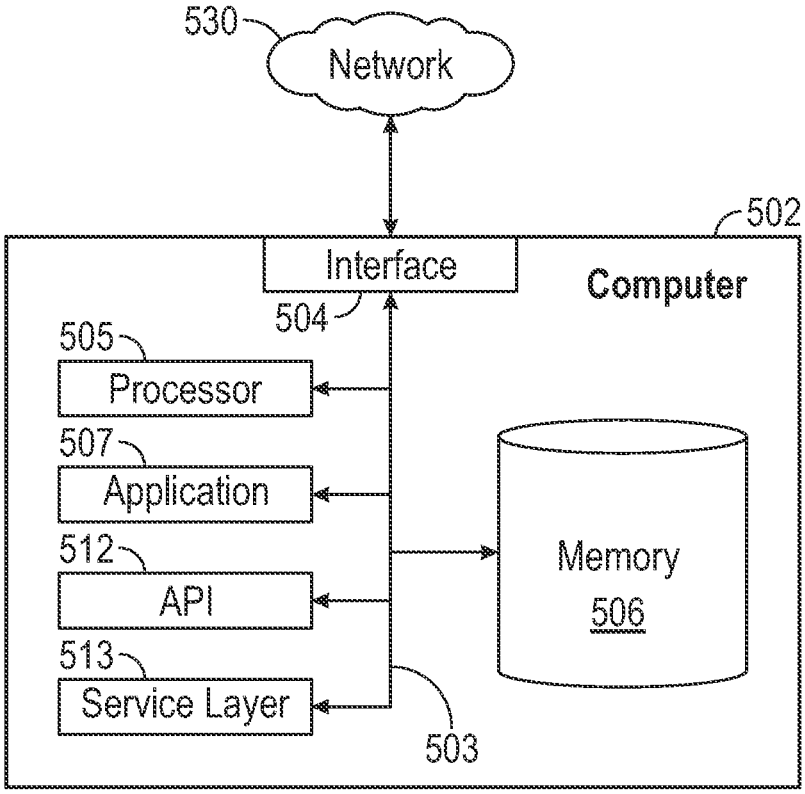
FIG. 5 shows a computer system in accordance with one or more embodiments.

Embodiments may be implemented on a computer system. FIG. 5 is a block diagram of a computer system (502) used to provide computational functionalities associated with described algorithms, methods, functions, processes, flows, and procedures as described in the instant disclosure, according to an implementation. The illustrated computer (502) is intended to encompass any computing device such as a high-performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (502) may include a computer that includes an input device, such as a keypad, keyboard, touch screen, or other device that can accept user information, and an output device that conveys information associated with the operation of the computer (502), including digital data, visual, or audio information (or a combination of information), or a GUI.

The computer (502) can serve in a role as a client, network component, a server, a database or other persistency, or any other component (or a combination of roles) of a computer system for performing the subject matter described in the instant disclosure. The illustrated computer (502) is communicably coupled with a network (530). In some implementations, one or more components of the computer (502) may be configured to operate within environments, including cloud-computing-based, local, global, or other environment (or a combination of environments).

At a high level, the computer (502) is an electronic computing device operable to receive, transmit, process, store, or manage data and information associated with the described subject matter. According to some implementations, the computer (502) may also include or be communicably coupled with an application server, e-mail server, web server, caching server, streaming data server, business intelligence (BI) server, or other server (or a combination of servers).

The computer (502) can receive requests over network (530) from a client application (for example, executing on another computer (502)) and responding to the received requests by processing the said requests in an appropriate software application. In addition, requests may also be sent to the computer (502) from internal users (for example, from a command console or by other appropriate access method), external or third-parties, other automated applications, as well as any other appropriate entities, individuals, systems, or computers.

Each of the components of the computer (502) can communicate using a system bus (503). In some implementations, any or all of the components of the computer (502), both hardware or software (or a combination of hardware and software), may interface with each other or the interface (504) (or a combination of both) over the system bus (503) using an application programming interface (API) (512) or a service layer (513) (or a combination of the API (512) and service layer (513)). The API (512) may include specifications for routines, data structures, and object classes. The API (512) may be either computer-language independent or dependent and refer to a complete interface, a single function, or even a set of APIs. The service layer (513) provides software services to the computer (502) or other components (whether or not illustrated) that are communicably coupled to the computer (502). The functionality of the computer (502) may be accessible for all service consumers using this service layer. Software services, such as those provided by the service layer (513), provide reusable, defined business functionalities through a defined interface. For example, the interface may be software written in JAVA, C++, or other suitable language providing data in extensible markup language (XML) format or other suitable format. While illustrated as an integrated component of the computer (502), alternative implementations may illustrate the API (512) or the service layer (513) as stand-alone components in relation to other components of the computer (502) or other components (whether or not illustrated) that are communicably coupled to the computer (502). Moreover, any or all parts of the API (512) or the service layer (513) may be implemented as child or sub-modules of another software module, enterprise application, or hardware module without departing from the scope of this disclosure.

The computer (502) includes an interface (504). Although illustrated as a single interface (504) in FIG. 5, two or more interfaces (504) may be used according to particular needs, desires, or particular implementations of the computer (502). The interface (504) is used by the computer (502) for communicating with other systems in a distributed environment that are connected to the network (530). Generally, the interface (504) includes logic encoded in software or hardware (or a combination of software and hardware) and operable to communicate with the network (530). More specifically, the interface (504) may include software supporting one or more communication protocols associated with communications such that the network (530) or interface's hardware is operable to communicate physical signals within and outside of the illustrated computer (502).

The computer (502) includes at least one computer processor (505). Although illustrated as a single computer processor (505) in FIG. 5, two or more processors may be used according to particular needs, desires, or particular implementations of the computer (502). Generally, the computer processor (505) executes instructions and manipulates data to perform the operations of the computer (502) and any algorithms, methods, functions, processes, flows, and procedures as described in the instant disclosure.

The computer (502) also includes a memory (506) that holds data for the computer (502) or other components (or a combination of both) that can be connected to the network (530). For example, memory (506) can be a database storing data consistent with this disclosure. Although illustrated as a single memory (506) in FIG. 5, two or more memories may be used according to particular needs, desires, or particular implementations of the computer (502) and the described functionality. While memory (506) is illustrated as an integral component of the computer (502), in alternative implementations, memory (506) can be external to the computer (502).

The application (507) is an algorithmic software engine providing functionality according to particular needs, desires, or particular implementations of the computer (502), particularly with respect to functionality described in this disclosure. For example, application (507) can serve as one or more components, modules, applications, etc. Further, although illustrated as a single application (507), the application (507) may be implemented as multiple applications (507) on the computer (502). In addition, although illustrated as integral to the computer (502), in alternative implementations, the application (507) can be external to the computer (502).

There may be any number of computers (502) associated with, or external to, a computer system containing computer (502), each computer (502) communicating over network (530). Further, the term "client," "user," and other appropriate terminology may be used interchangeably as appropriate without departing from the scope of this disclosure. Moreover, this disclosure contemplates that many users may use one computer (502), or that one user may use multiple computers (502).

In some embodiments, the computer (502) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, a cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed:

1. A method comprising:

disposing an electric submersible pump (ESP) inside a wellbore, wherein the ESP comprises an electric motor that provides an artificial lift to hydrocarbon production from a hydrocarbon reservoir to a well surface;

obtaining wellhead data from a wellhead associated with the ESP using a well monitoring and control system connected to the wellbore and a plurality of sensors, wherein the wellhead data comprises wellhead temperature data and wellhead pressure data;

obtaining ESP operational data from the ESP, wherein the ESP operational data comprises voltage data for the ESP, current data for the ESP, power data for the ESP, motor temperature data for the ESP, discharge pressure data for the ESP, vibration data for the ESP, and frequency data for the ESP;

predicting, by a computer system, a remaining expected life of the ESP using a machine-learning model, the wellhead data, and the ESP operational data, wherein the machine-learning model is a random forest model that performs a regression using the wellhead data and the ESP operational data to predict a timeline of a failure event for the ESP, and wherein the random forest model comprises a plurality of decision trees that are trained using bootstrap aggregating; and repairing the ESP based on the remaining expected life of the ESP.

2. The method of claim 1, wherein the ESP operational data comprises ESP operational parameters, environmental parameters, design parameters, historical data, or equipment specifications.

3. The method of claim 1, further comprising reporting the remaining expected life by identifying that the remaining expected life is below a specified threshold value.

4. The method of claim 1, further comprising determining features in the ESP operational data that have a highest impact on extending the remaining expected life of the ESP.

5. The method of claim 4, wherein determining the features comprises at least one selected from a group consisting of limiting an idle time of the ESP prior to active service, optimizing parameters for the ESP to operate efficiently, and optimize a design of the ESP.

* * * * *